US006229485B1

(12) United States Patent
Ito et al.

(10) Patent No.: US 6,229,485 B1
(45) Date of Patent: May 8, 2001

(54) ANTENNA DEVICE

(75) Inventors: Hiroki Ito, Kanagawa; Masatoshi Sawamura, Saitama; Yuichiro Saito, Chiba, all of (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 09/370,176

(22) Filed: Aug. 9, 1999

(30) Foreign Application Priority Data

Aug. 10, 1998 (JP) ..... 10-226341

(51) Int. Cl.[7] ..... H01Q 3/02; H01Q 1/38
(52) U.S. Cl. ..... 343/700 MS; 343/846
(58) Field of Search ..... 343/700 MS, 846, 343/847, 829, 702

(56) References Cited

U.S. PATENT DOCUMENTS 5,041,838 * 8/1991 Limatainen et al. ..... 343/700 MS
5,307,075 * 4/1994 Huynh ..... 343/700 MS
5,801,660 * 9/1998 Ohtsuka et al. ..... 343/700 MS
6,002,367 * 12/1999 Engblom et al. ..... 343/700 MS

* cited by examiner

*Primary Examiner*—Hoanganh Le
*Assistant Examiner*—Ephrem Alemu
(74) *Attorney, Agent, or Firm*—Jay H. Maioli

(57) ABSTRACT

An antenna device includes a flat ground conductor; a first flat radiation conductor disposed against the flat ground conductor interposing a first dielectric layer; a first short-circuit conductor connecting an end of the first flat radiation conductor and the flat ground conductor; a second flat radiation conductor disposed partly against an opposite side of the first flat radiation conductor with its other side facing the ground conductor interposing a second dielectric layer; a second short-circuit conductor connecting an end of the second flat radiation conductor and the flat ground conductor; and a supply point disposed on the first flat radiation conductor. With this structure, the first flat radiation conductor and the second flat radiation conductor are disposed partly against each other, which enables more size reduction than that of conventional antennas operating at the same resonant frequency.

4 Claims, 13 Drawing Sheets

1

6

10

CROSS-SECTIONAL VIEW TAKEN ALONG 8B-8B

CROSS-SECTIONAL VIEW TAKEN ALONG 9B-9B

CROSS-SECTIONAL VIEW TAKEN ALONG 11B-11B

CROSS-SECTIONAL VIEW TAKEN ALONG 12B-12B

CROSS-SECTIONAL VIEW TAKEN ALONG 13B-13B

ANTENNA DEVICE

BACKGROUND OF THE INVENTION

1. Field of the Invention

The present invention relates to an antenna device, and more particularly, is suitably applied to a portable telephone which is reduced in size.

2. Description of the Related Art

In small portable radio apparatus such as portable telephones, terminal units for personal handyphone system (PHS), or the like, a reduction in size, thickness and weight has been promoted with recent rapid development of such apparatuses. Correspondingly, antennas associated therewith are also required to have a reduced size, thickness and weight as well as higher performance.

An example of an antenna equipped in such a small portable radio apparatus is a micro-strip antenna (hereinafter referred to as the "MS antenna"). Further, commonly known as antennas, which are further reduced in size than the MS antennas, are a single-side short-circuited MS antenna having a short-circuit surface for short-circuiting a zero-potential surface at the center of a radiation conductor to a ground conductor, a laminar inverted-F antenna having a further reduced width of its short-circuit surface, and so on.

For example, as illustrated in FIGS. 1A and 1B, a conventional MS antenna 1 comprises a ground conductor 2 disposed on one side of a dielectric substrate 3 having a height h, and a rectangular radiation conductor 4 (length a×width b) formed on the other side of the substrate 3 using an etching technique or the like.

This MS antenna 1 is provided with a power supply point 5 at a predetermined position on the radiation conductor 4 so that the input impedance thereof is equal to the characteristic impedance of a power supply system. The MS antenna 1 operates as an antenna with power supplied thereto through the power supply point 5.

As illustrated in FIGS. 2A and 2B, a single-side short-circuited MS antenna 6 comprises a short-circuit conductor 10 having a width Ws1 identical to the width b of a radiation conductor 8 and a height h, disposed between the radiation conductor 8 and a ground conductor 7, so as to short-circuit a zero-potential surface of the radiation conductor 8 to the ground conductor 7. The zero-potential surface, at which an electric field is at "0," is at a position corresponding to one half a/2 of the length a of the radiation conductor 4 in the normal MS antenna 1.

With this structure, the single-side short-circuited MS antenna 6 only requires the radiation conductor 8 having a length dimension approximately one half of the length dimension of the radiation conductor 4 of the MS antenna 1 and still operates as an antenna at the same resonant frequency as the MS antenna 1.

Further, as illustrated in FIGS. 3A and 3B, a laminar inverted-F antenna 10 is composed of a rectangular radiation conductor 12 (length c×width d) and a ground conductor 11 which are short-circuited by a laminar inverted-F short-circuit conductor 14 having a width Ws2 smaller than the width Ws1 of the short-circuit conductor 10 of the single-side short-circuited MS antenna 6.

The laminar inverted-F antenna 10 can reduce the resonant frequency fr by virtue of the laminar inverted-F short-circuit conductor 14 having the width Ws2 chosen to be smaller than the width Ws1 of the short-circuit conductor 8 of the single-side short-circuited MS antenna 6, and can further reduce the resonant frequency fr by virtue of the power supply point 5 defined at a position offset from the center line of the radiation conductor 12 by an offset amount Wx2, as compared with the power supply point 5 defined at the center of the radiation conductor 12.

As mentioned above, since the laminar inverted-F antenna 10 is designed to reduce the resonant frequency fr more than the MS antenna 1, it can be configured using the radiation conductor 12 (length c×width d) smaller than the radiation conductor 4 (length a×width b), when it is operated at the same frequency as the MS antenna 1.

The single-side short-circuited MS antenna 6 and the laminar inverted-F antenna 10, configured as described above, are required to be further reduced in size in response to the demand for increasingly smaller portable telephones in recent years.

SUMMARY OF THE INVENTION

In view of the foregoing, an object of this invention is to provide an antenna device which is capable of realizing a further reduction in size and weight.

The foregoing object and other objects of the invention have been achieved by the provision of an antenna device which comprises a flat ground conductor; a first flat radiation conductor disposed against the flat ground conductor interposing a first dielectric layer; a first short-circuit conductor connecting an end of the first flat radiation conductor and the flat ground conductor; a second flat radiation conductor disposed partly against an opposite side of the first flat radiation conductor to its other side facing the ground conductor interposing a second dielectric layer; a second short-circuit conductor connecting an end of the second flat radiation conductor and the flat ground conductor; and a supply point disposed on the first flat radiation conductor.

With the structure as above, the first flat radiation conductor and the second flat radiation conductor are disposed partly against each other, which enables more size reduction than that of conventional antennas in operating at the same resonant frequency with a conventional antenna.

The nature, principle and utility of the invention will become more apparent from the following detailed description when read in conjunction with the accompanying drawings in which like parts are designated by like reference numerals or characters.

DETAILED DESCRIPTION OF THE EMBODIMENT

Preferred embodiment of this present invention will be described with reference to the accompanying drawings:

(1) First Embodiment

Figure 4:
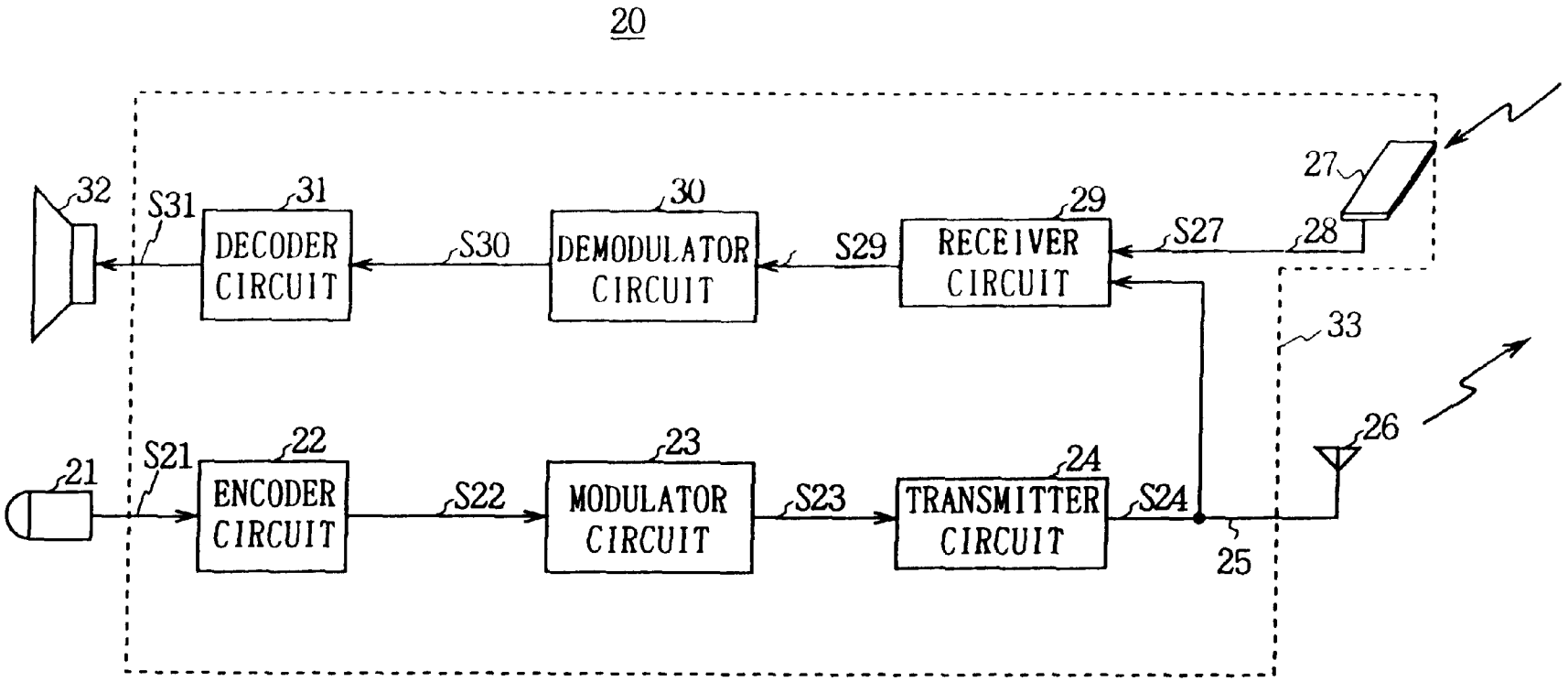
FIG. 4 is a block diagram illustrating the configuration of a portable radio apparatus according to a first embodiment of the present invention.

In FIG. 4, a portable radio apparatus, generally designated by 20, sends a voice signal S21 collected through a microphone 21 to an encoder circuit 22 upon transmission. The encoder circuit 22 encodes the voice signal S21 to generate audio data S22 which is sent to a modulator circuit 23. The modulator circuit 23 performs predetermined modulation processing based on the audio data S22 to generate a modulation signal S23 which is sent to a transmitter circuit 24.

The transmitter circuit 24 digital-to-analog converts the modulation signal S23 to generate an analog signal which is then frequency converted to generate a transmission signal S25. The transmission signal S25 is amplified to a predetermined power level, and transmitted through a power supply line 25 and an external antenna 26 which comprises, for instance, an externally attached whip antenna.

Upon reception, the portable radio apparatus 20 receives a reception signal S27 through the external antenna 26 and a planar antenna 27, and sends the reception signal S27 to a receiver circuit 27 through the power supply line 25 and a power supply line 28. The receiver circuit 29 amplifies the reception signal S29 to a predetermined power level, and then frequency converts the amplified signal to extract a baseband signal. Subsequently, the receiver circuit 29 analog-to-digital converts the baseband signal to a digital signal to generate a received data S29 which is sent to a demodulator circuit 30.

The demodulator circuit 30 performs predetermined demodulation processing on the received data S29 to generate a demodulated signal S30 which is sent to a decoder circuit 31. The decoder circuit 31 decodes the demodulated signal S30 to generate an analog signal, thus recovering a voice signal S31 identical to an original voice signal 21 which is outputted through a speaker 32 as a voice.

The portable radio apparatus 20, when in use, transmits a transmission signal S24 and receives a reception signal S27 with the external antenna 26 for both transmission and reception, which is drawn out from a housing 33 for use and otherwise can be retracted inside the housing 33. The portable radio apparatus 20 also receives the reception signal S27 through the planar antenna 27, implemented by the laminar inverted-F antenna 27 dedicated to reception which is always accommodated within the housing 33. In this way, the portable radio apparatus 20 conducts diversity reception, during reception, to improve the reception performance. In this embodiment, the structure of the laminar inverted-F antenna 27, constituting the planar antenna 27, will be described in detail.

Figure 3A:
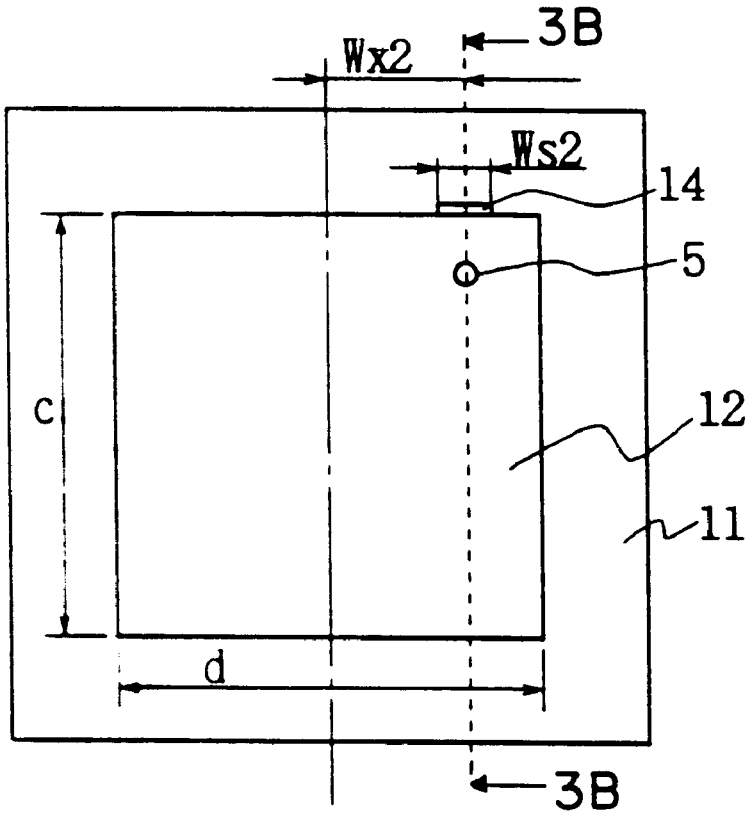
FIG. 3A (PRIOR ART)
FIGS. 3A and 3B are a top plan view and a cross-sectional view illustrating the structure of a conventional laminar inverted-F antenna.
Figure 3B:
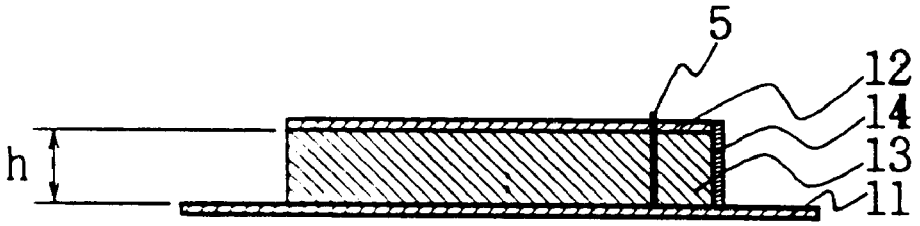
FIG. 3B (PRIOR ART)
Figure 5A:
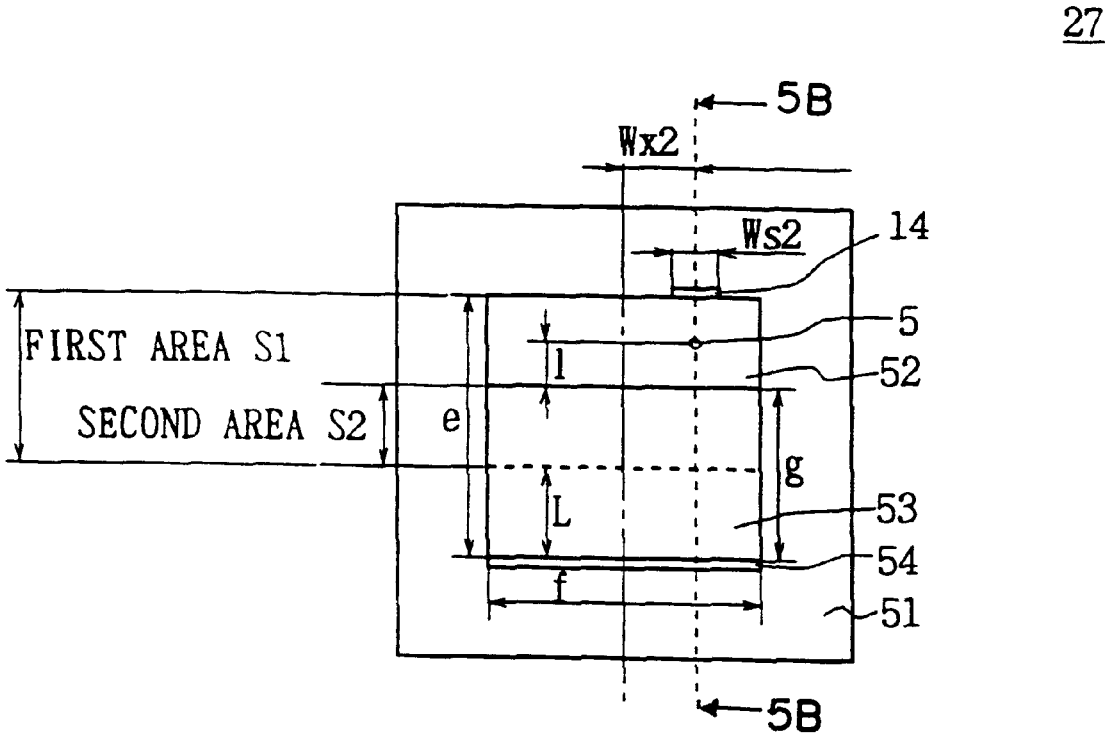
FIGS. 5A and 5B are a top plan view and a cross-sectional view illustrating the structure of a laminar inverted-F antenna according to the first embodiment of the present invention.
Figure 5B:
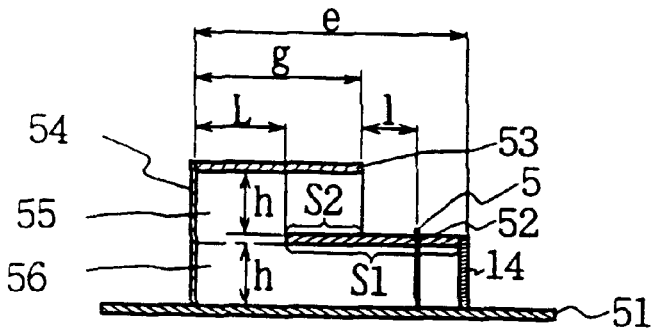

In FIGS. 5A and 5B, where parts corresponding to those in FIGS. 3A and 3B are designated with the same reference numerals, a laminar inverted-F antenna according to the present invention, generally designated by 27. Which comprises a radiation conductor 52 having a length (e-L) and a width f, a ground conductor 51, and a laminar inverted-F short-circuit conductor 14 which short-circuits the ground conductor 51 and the radiation conductor 52 having a width Ws2 and a height h, these to form a normal laminar inverted-F antenna. An upper ground conductor 53 disposed at a position spaced from the radiation conductor 52 by a height h and having a length g and a width f, is short-circuited to the ground conductor 51 by a side ground conductor 54 having a width f, which is disposed on an open end side on which the laminar inverted-F short-circuit conductor 14 is not disposed.

With the foregoing structure, the laminar inverted-F antenna 27 is designed to act as a first antenna with a lower dielectric layer 56 formed of an air layer between the radiation conductor 52 and the ground conductor 51, as well as to act as a second antenna with an upper dielectric layer 55 formed of an air layer between the radiation conductor 52 and the upper ground conductor 53.

The laminar inverted-F antenna 27 also has a power supply point 5 defined at a position spaced by a distance l from an end of the upper ground conductor 53 overlying the radiation conductor 52, and offset from the center line of the radiation conductor 52 by an offset amount Wx2, so that the input impedance of the radiation conductor 52 is equal to the characteristic impedance of a power supply system, thus achieving the impedance matching.

With the foregoing structure, the laminar inverted-F antenna device 27 has a first area S1 on one side of the radiation conductor 52 which acts as a first antenna in combination of the ground conductor 51 short-circuited by the laminar inverted-F short-circuit conductor 14, and an additional second area S2 on the other side of the radiation conductor 52 which acts as a second antenna in combination of the upper ground conductor 53 short-circuited by the side ground conductor 54. Thus, the laminar inverted-F antenna device 27 has an increased area (S1+S2), as a whole, for the radiation conductor 52, which acts as the overall antenna, resulting in a correspondingly increased capacitance to further reduce the resonant frequency fr.

Actually, in the laminar inverted-F antenna 27, when the length (e-L) of the radiation conductor 52 is reduced while the distance L from the end of the radiation conductor 52 to the side ground conductor 54 is extended, the second area S2 is reduced, resulting in a correspondingly reduced capacitance to increase the resonant frequency fr. Conversely, when the length (e-L) of the radiation conductor 52 is extended while the distance L is reduced, the second area S2 is increased, resulting in a correspondingly increased capacitance to reduce the resonant frequency fr.

Also, in the laminar inverted-F antenna 27, when the length g of the upper ground conductor 53 is reduced while the distance l from the end of the upper ground conductor 53 to the power supply point 5 is extended, the second area S2 is reduced, resulting in a correspondingly reduced capacitance to increase the resonant frequency fr. Conversely, when the length g of the upper ground conductor 53 is extended while the distance l from the end of the upper ground conductor 53 to the power supply point 5 is reduced, the second area S2 is increased, resulting in a correspondingly increased capacitance to reduce the resonant frequency fr.

Figure 6:
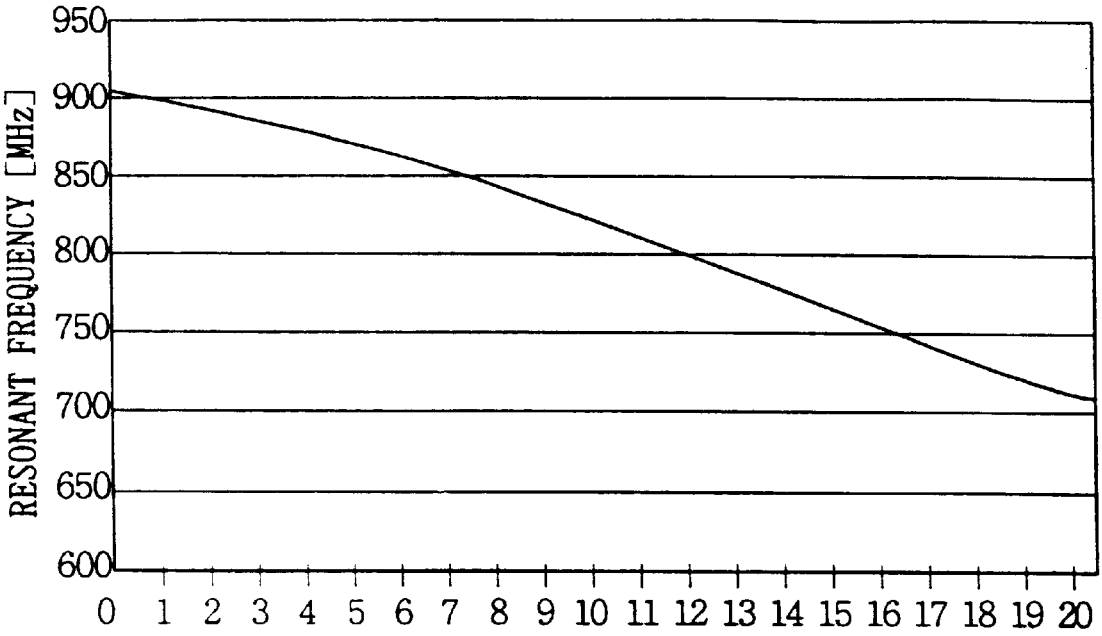
FIG. 6 is a graph showing the relationship between the dimensions of an upper ground conductor of the laminar inverted-F antenna according to the first embodiment of the present invention and the resonant frequency.

Actually, as shown in FIG. 6, it can be seen that in the laminar inverted-F antenna 27, as the length g of the upper ground conductor 5 is longer, the distance l from the end of the upper ground conductor 53 to the power supply point 5 is more reduced to cause an increase in the second area S2, resulting in a correspondingly increased capacitance to reduce the resonant frequency fr.

As described above, the laminar inverted-F antenna 27 can provide a desired resonant frequency by changing the length g of the upper ground conductor 53 and the length (e-L) of the radiation conductor 52 to adjust the area of the radiation conductor 52 which acts as the first and second antennas.

Figure 7:
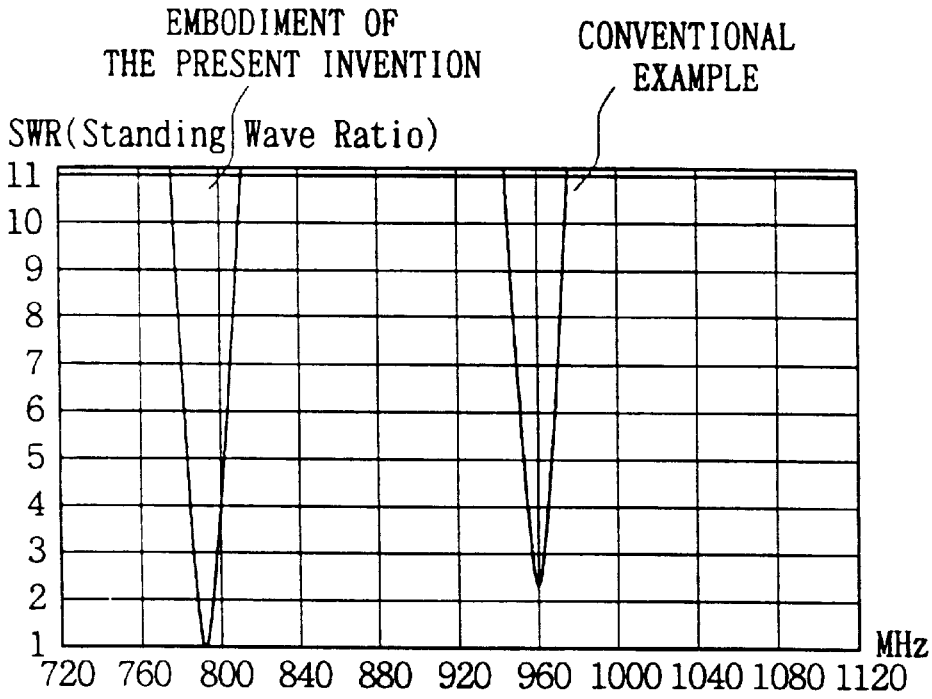
FIG. 7 is a characteristic curve showing the resonant frequency of the laminar inverted-F antenna according to the first embodiment of the present invention.

More specifically, as can be seen from the result of an experiment shown in FIG. 7, the resonant frequency resulting from the use of the laminar inverted-F antenna 27 according to the present invention is at approximately 790 MHz, whereas the resonant frequency resulting from the use of the conventional laminar inverted-F antenna 10 is at approximately 960 MHz. The resonant frequency is significantly reduced by approximately 170 MHz.

With the foregoing structure, the laminar inverted-F antenna 27 according to the present invention employs a double-layer structure which includes a first antenna formed of a combination of the radiation conductor 52 and the ground conductor 51 short-circuited by the laminar inverted-F short-circuit conductor 14, and a second antenna formed of a combination of the radiation conductor 52 and the upper ground conductor 53 short-circuited by the side ground conductor 54. Thus, the first area S1 on the one side of the radiation conductor 52 acting as the first antenna and the second area S2 on the other side of the radiation conductor 52 acting as the second antenna are added to increase the area of the radiation conductor 52 acting as the overall antenna, so that the capacitance of the antenna can be increased as a whole. Consequently, the laminar inverted-F antenna 27 can reduce the resonant frequency fr without causing increased dimensions (length e×width f), as compared with the dimensions (length c×width d) of the conventional laminar inverted-F antenna 10.

Thus, the laminar inverted-F antenna 27 can further reduce the overall size thereof by an amount corresponding to a reduction in the resonant frequency fr, when operated at the same frequency as the conventional laminar inverted-F antenna 10, thereby making it possible to reduce the area of the antenna equipped in the portable radio apparatus 20 and hence the entire size of the portable radio apparatus 20.

In addition, since the laminar inverted-F antenna 27 employs the upper dielectric layer 55 and the lower dielectric layer 56 formed of air layers, the laminar inverted-F antenna 27 can be reduced in weight as compared with the conventional laminar inverted-F antenna 10 which employs the dielectric substrate 3.

According to the foregoing structure, the laminar inverted-F antenna 27 in the first embodiment employs the double-layer structure which includes the first antenna formed of a combination of the radiation conductor 52 and the ground conductor 51 short-circuited by the laminar inverted-F short-circuit conductor 14, and the second antenna formed of a combination of the radiation conductor 52 and the upper ground conductor 53 short-circuited by the side ground conductor 54, thereby making it possible to further reduce the resonant frequency fr and the size of the overall antenna.

(2) Second Embodiment

Since a second embodiment has the same circuit configuration as the first embodiment except for a circuit associated with a laminar inverted-F antenna 60, later described, which is employed instead of the laminar inverted-F antenna 27 of the portable radio apparatus 20 (FIG. 4), description will be made herein only on the structure of the laminar inverted-F antenna 60.

Figure 8A:
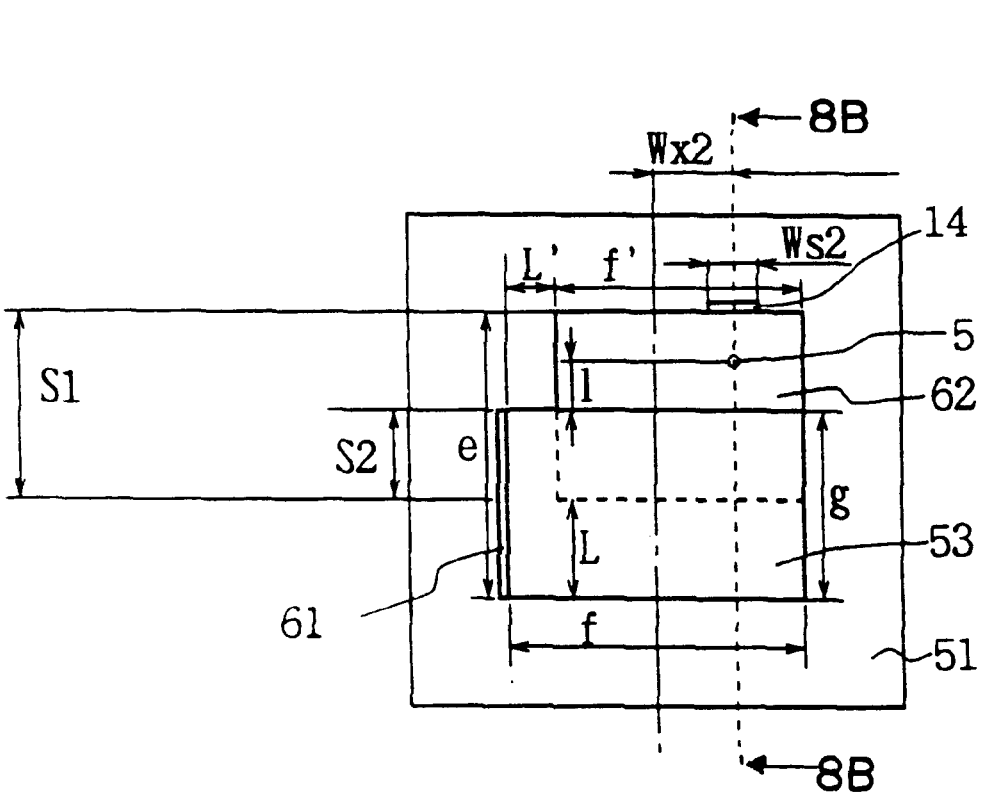
FIGS. 8A and 8B are a top plan view and a cross-sectional view illustrating the structure of a laminar inverted-F antenna according to a second embodiment of the present invention.
Figure 8B:
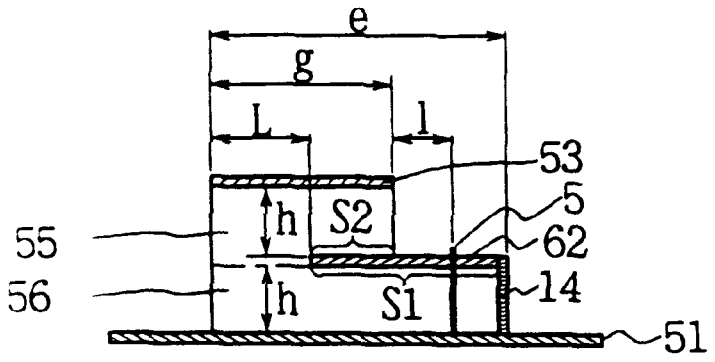

In FIGS. 8A and 8B, where parts corresponding to those in FIGS. 5A and 5B are designated with the same reference numerals, the laminar inverted-F antenna 60 comprises a side ground conductor 61 disposed on the side of an upper ground conductor 53 orthogonal to an open end side, on which a laminar inverted-F short-circuit conductor 14 is not disposed, so as to short-circuit the upper ground conductor 53 to a ground conductor 51 in place of the side ground conductor 54 of the laminar inverted-F antenna 27 in the first embodiment. In addition, a radiation conductor 62 has a width f', and is spaced apart from the side ground conductor 61 by a distance L' to avoid short-circuiting.

Again, in the laminar inverted-F antenna 60, the upper ground conductor 53 and the ground conductor 51 are short-circuited by the side ground conductor 61 in a manner similar to the laminar inverted-F antenna 27, so that a first antenna can be formed of a combination of the radiation conductor 62 and the ground conductor 51 short-circuited by the laminar inverted-F short-circuit conductor 14, and a second antenna can be formed of a combination of the radiation conductor 62 and the upper ground conductor 53 short-circuited by the side ground conductor 61.

In the foregoing structure, the first area S1 on one side of the radiation conductor 62 acting as the first antenna and the second area S2 on the other side of the radiation conductor 62 acting as the second antenna are added to increase the area of the radiation conductor 62 acting as the overall antenna, so that the capacitance of the antenna device can be increased. Consequently, the laminar inverted-F antenna 60 can reduce the resonant frequency fr without causing increased dimensions (length e×width f) as compared with the dimensions (length c×width d) of the conventional laminar inverted-F antenna 10.

Thus, the laminar inverted-F antenna 60 can further reduce the overall size thereof by an amount corresponding to a reduction in the resonant frequency fr, when operated at the same frequency as the conventional laminar inverted-F antenna 10, thereby making it possible to reduce the area of the antenna equipped in the portable radio apparatus 20 and hence the entire size of the portable radio apparatus 20.

In addition, since the laminar inverted-F antenna 60 employs an upper dielectric layer 55 and a lower dielectric layer 56 formed of air layers, the laminar inverted-F antenna 60 can be reduced in weight as compared with the conventional laminar inverted-F antenna 10 which employs the dielectric substrate 3.

According to the foregoing structure, the laminar inverted-F antenna 60 in the second embodiment employs the double-layer structure which includes the first antenna formed of a combination of the radiation conductor 62 and the ground conductor 51 short-circuited by the laminar inverted-F short-circuit conductor 14, and the second antenna formed of a combination of the radiation conductor 62 and the upper ground conductor 53 short-circuited by the side ground conductor 61, thereby making it possible to further reduce the resonant frequency fr and the size of the overall antenna.

(3) Third Embodiment

Since a third embodiment has the same circuit configuration as the first embodiment except for a circuit associated with a laminar inverted-F antenna 70, later described, which is employed instead of the laminar inverted-F antenna 27 of the portable radio apparatus 20 (FIG. 4), description will be made herein only on the structure of the laminar inverted-F antenna 70.

Figure 9A:
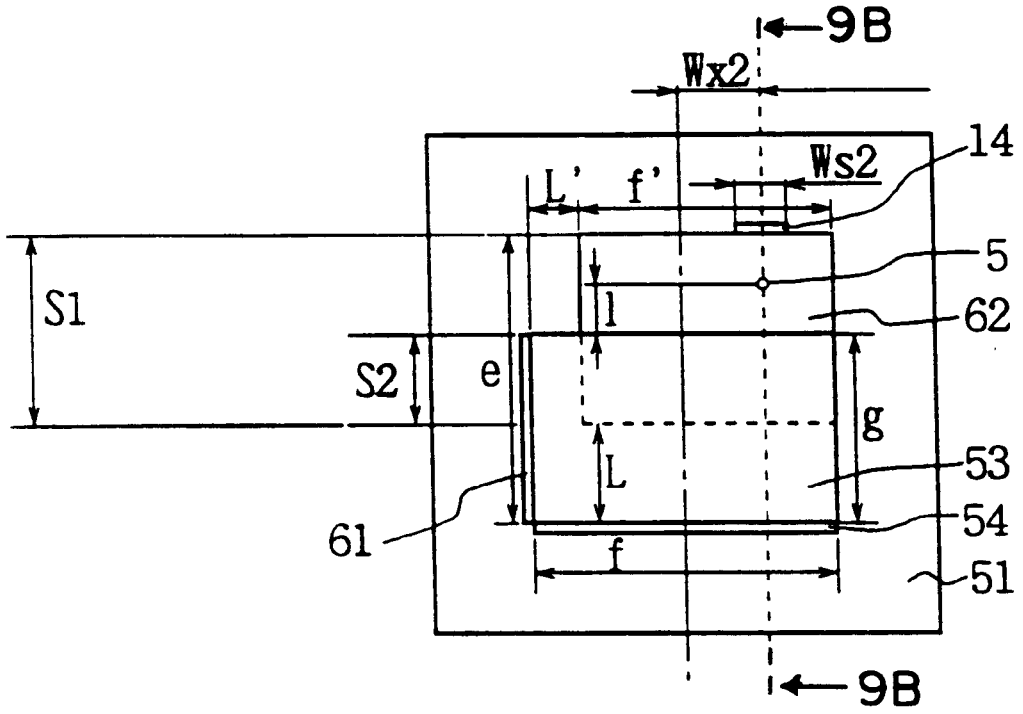
FIGS. 9A and 9B are a top plan view and a cross-sectional view illustrating the structure of a laminar inverted-F antenna according to a third embodiment of the present invention.
Figure 9B:
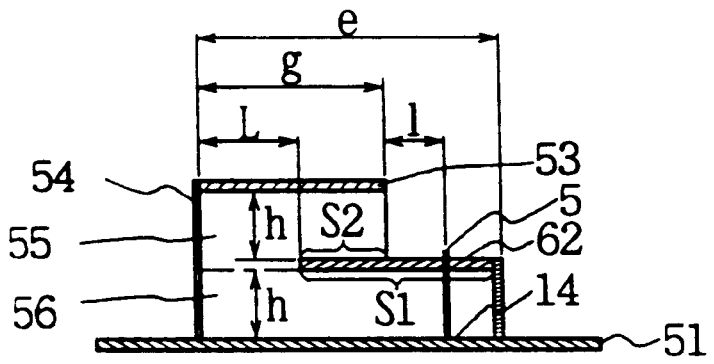

In FIGS. 9A and 9B, where parts corresponding to those in FIGS. 8A and 8B are designated with the same reference numerals, the laminar inverted-F antenna 70 comprises both the side ground conductor 54 of the laminar inverted-F antenna 27 in the first embodiment, and the side ground conductor 61 of the laminar inverted-F antenna 60 in the second embodiment.

Again, in the laminar inverted-F antenna 70, an upper ground conductor 53 and a ground conductor 51 are short-circuited by the side ground conductors 54, 61 in a manner similar to the laminar inverted-F antennas 27, 60, so that a first antenna can be formed of a combination of a radiation conductor 62 and the ground conductor 51 short-circuited by the laminar inverted-F short-circuit conductor 14, and a second antenna can be formed of a combination of the radiation conductor 62 and the upper ground conductor 53 short-circuited by the side ground conductors 54, 61.

In the foregoing structure, the laminar inverted-F antenna 70 is such that a first area S1 on one side of the radiation conductor 62 acting as the first antenna and a second area S2 on the other side of the radiation conductor 62 acting as the second antenna are added to increase the area of the radiation conductor 62 acting as the overall antenna, so that the capacitance of the antenna can be increased as a whole. Consequently, the laminar inverted-F antenna 70 can reduce the resonant frequency fr without causing increased dimensions (length e×width f), as compared with the dimensions (length c×width d) of the conventional laminar inverted-F antenna 10.

Thus, the laminar inverted-F antenna 70 can further reduce the overall size thereof by an amount corresponding to a reduction in the resonant frequency fr, when operated at the same frequency as the conventional laminar inverted-F antenna 10, thereby making it possible to reduce the area of the antenna equipped in the portable radio apparatus 20 and hence the entire size of the portable radio apparatus 20.

In addition, since the laminar inverted-F antenna 70 employs an upper dielectric layer 55 and a lower dielectric layer 56 formed of air layers, the laminar inverted-F antenna 70 can be reduced in weight as compared with the conventional laminar inverted-F antenna 10 which employs the dielectric substrate 3.

According to the foregoing structure, the laminar inverted-F antenna 70 in the third embodiment employs the double-layer structure which includes the first antenna formed of a combination of the radiation conductor 62 and the ground conductor 51 short-circuited by the laminar inverted-F short-circuit conductor 14, and the second antenna formed of a combination of the radiation conductor 62 and the upper ground conductor 53 short-circuited by the side ground conductors 54, 61, thereby making it possible to further reduce the resonant frequency fr and the size of the overall antenna.

(4) Fourth Embodiment

Since a fourth embodiment has the same circuit configuration as the first embodiment except for a circuit associated with a single-side short-circuited MS antenna 80, later described, which is employed instead of the laminar inverted-F antenna 27 of the portable radio apparatus 20 (FIG. 4), description will be made herein only on the structure of the single-side short-circuited MS antenna 80.

Figure 1A:
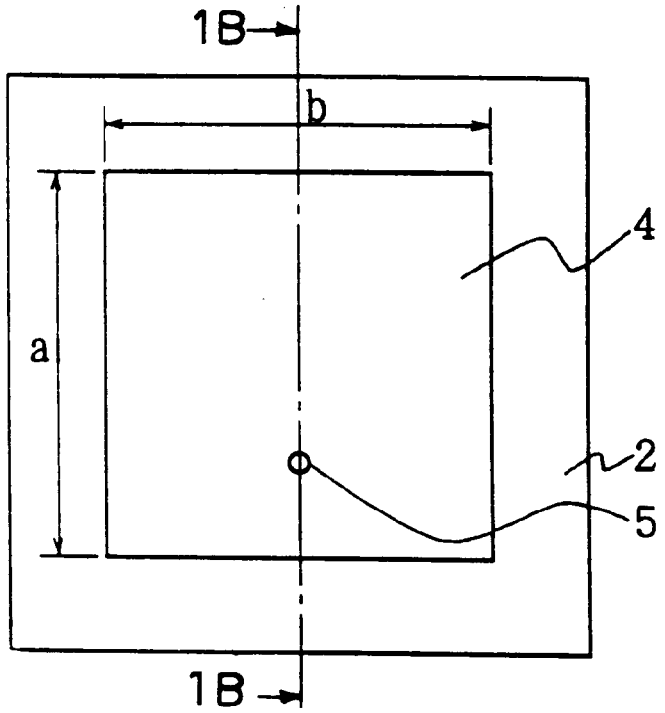
FIG. 1A (PRIOR ART)
FIGS. 1A and 1B are a top plan view and a cross-sectional view illustrating the structure of a conventional MS antenna.
Figure 1B:
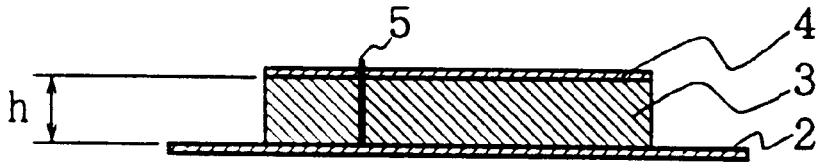
FIG. 1B (PRIOR ART)
Figure 2A:
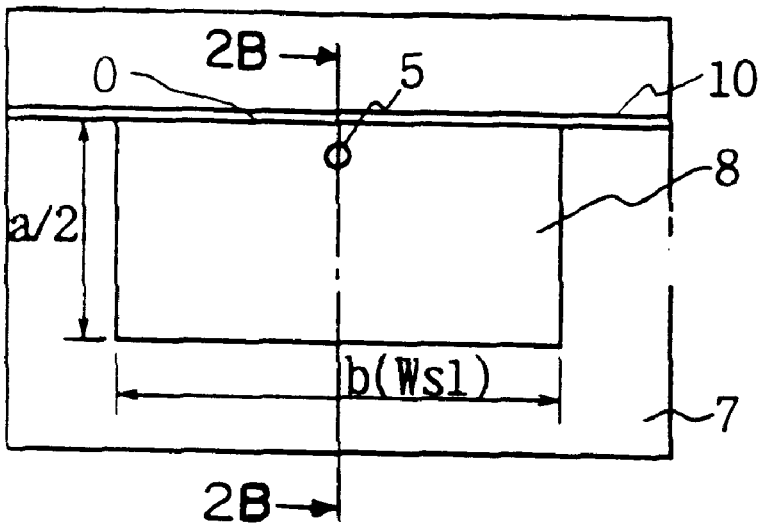
FIG. 2A (PRIOR ART)
FIGS. 2A and 2B are a top plan view and a cross-sectional view illustrating the structure of a conventional single-side short-circuited MS antenna.
Figure 2B:
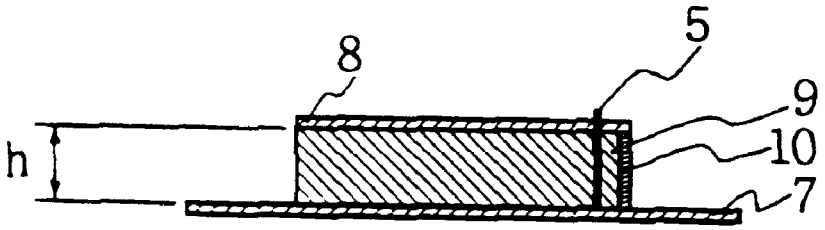
FIG. 2B (PRIOR ART)
Figure 10A:
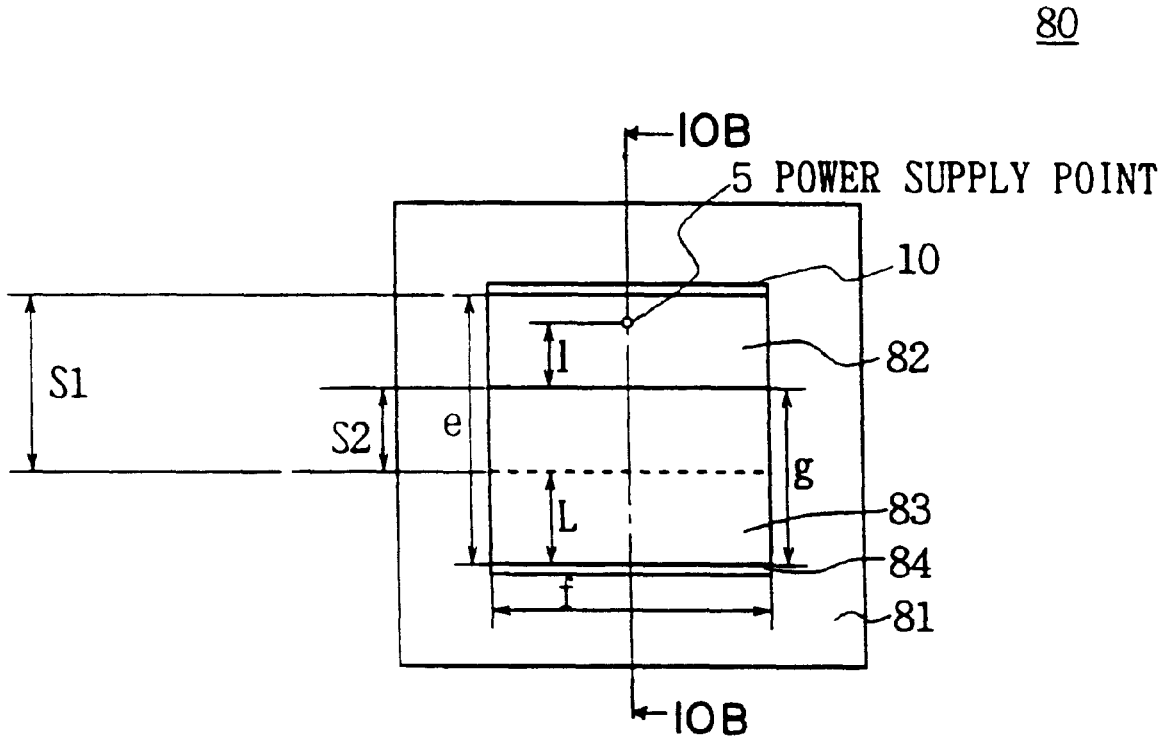
FIGS. 10A and 10B are a top plan view and a cross-sectional view illustrating the structure of a single-side short-circuited MS antenna according to a fourth embodiment of the present invention.
Figure 10B:
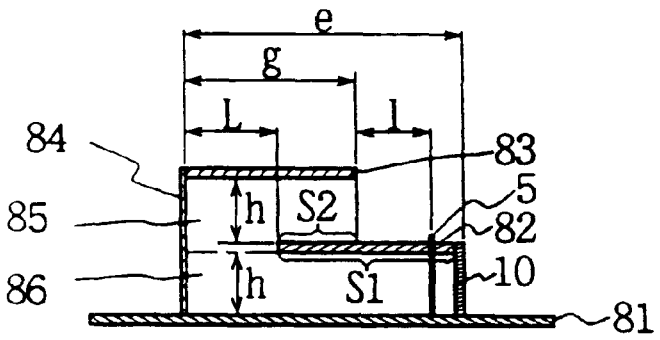

In FIGS. 10A and 10B, where parts corresponding to those in FIGS. 2A and 2B are designated with the same reference numerals, the single-side short-circuited MS antenna 80 comprises a radiation conductor 82 having a length (e-L) and a width f, and a ground conductor 81, short-circuited by a short-circuit conductor 10 having a width f and a height h to form a normal single-side short-circuited antenna. The antenna 80 also comprises an upper ground conductor 83 disposed at a position spaced from the radiation conductor 82 by a height h and having a length g and a width f, which is short-circuited to the ground conductor 81 by a side ground conductor 84 having a width f, which is disposed on an open end side on which the short-circuit conductor 10 is not disposed.

With the foregoing structure, the single-side short-circuited MS antenna 80 is designed to operate as a first antenna with a lower dielectric layer 86 formed of an air layer between the radiation conductor 82 and the ground conductor 81, as well as to operate as a second antenna with an upper dielectric layer 85 formed of an air layer between the radiation conductor 82 and the upper ground conductor 83.

The single-side short-circuited MS antenna 80 also has a power supply point 5 defined at a position on the center line of the radiation conductor 82 spaced by a distance l from an end of the upper ground conductor 83 overlying the radiation conductor 82, so that the input impedance of the radiation conductor 82 is equal to the characteristic impedance of a power supply system, thus achieving the impedance matching.

With the foregoing structure, the single-side short-circuited MS antenna 80 has a first area S1 on one side of the radiation conductor 82 which acts as the first antenna in combination of the ground conductor 81 short-circuited by the short-circuit conductor 10, and an additional second area S2 on the other side of the radiation conductor 82 which acts as the second antenna in combination of the upper ground conductor 83 short-circuited by the side ground conductor 84. Thus, the single-side short-circuited MS antenna 80 has an increased area (S1+S2), as a whole, for the radiation conductor 82, which acts as the overall antenna, resulting in an increased capacitance to further reduce the resonant frequency fr.

Actually, in the single-side short-circuited MS antenna 80, when the length (e-L) of the radiation conductor 82 is reduced while the distance L from the end of the radiation conductor 82 to the side ground conductor 84 is extended, the second area S2 is reduced, resulting in a correspondingly reduced capacitance to increase the resonant frequency fr.

Conversely, when the length (e-L) of the radiation conductor 82 is extended while the distance L is reduced, the second area S2 is increased, resulting in a correspondingly increased capacitance to reduce the resonant frequency fr.

Also, in the single-side short-circuited MS antenna 80, when the length g of the upper ground conductor 83 is reduced while the distance l from the end of the upper ground conductor 83 to the power supply point 5 is extended, the second area S2 is reduced, resulting in a correspondingly reduced capacitance to increase the resonant frequency fr. Conversely, when the length g of the upper ground conductor 83 is extended while the distance l from the end of the upper ground conductor 83 to the power supply point 5 is reduced, the second area S2 is increased, resulting in a correspondingly increased capacitance to reduce the resonant frequency fr.

As described above, the single-side short-circuited MS antenna 80 can provide a desired resonant frequency by changing the length g of the upper ground conductor 83 and the length (e-L) of the radiation conductor 82 to adjust the area of the radiation conductor 82 which acts as the first and second antennas.

With the foregoing structure, the single-side short-circuited MS antenna 80 according to the fourth embodiment employs a double-layer structure which includes the first antenna formed of a combination of the radiation conductor 82 and the ground conductor 81 short-circuited by the short-circuit conductor 10, and the second antenna formed of a combination of the radiation conductor 82 and the upper ground conductor 83 short-circuited by the side ground conductor 84. Thus, the first area S1 on the one side of the radiation conductor 82 acting as the first antenna and the second area S2 on the other side of the radiation conductor 82 acting as the second antenna are added to increase the area of the radiation conductor 82 acting as the overall antenna, so that the capacitance of the antenna can be increased as a whole. Consequently, the single-side short-circuited MS antenna 80 can reduce the resonant frequency fr without causing increased dimensions (length e×width f), as compared with those of the conventional single-side short-circuited MS antenna 6.

Thus, the single-side short-circuited MS antenna 80 can further reduce the overall size thereof by an amount corresponding to a reduction in the resonant frequency fr, when operated at the same frequency as the conventional single-side short-circuited MS antenna 6, thereby making it possible to reduce the area of the antenna equipped in the portable radio apparatus 20 and hence the entire size of the portable radio apparatus 20.

In addition, since the single-side short-circuited MS antenna 80 employs the upper dielectric layer 85 and the lower dielectric layer 86 formed of air layers, the single-side short-circuited MS antenna 80 can be reduced in weight as compared with the conventional single-side short-circuited MS antenna 6 which employs the dielectric substrate 9.

According to the foregoing structure, the single-side short-circuited MS antenna 80 in the fourth embodiment employs the double-layer structure which includes the first antenna formed of a combination of the radiation conductor 82 and the ground conductor 81 short-circuited by the short-circuit conductor 10, and the second antenna formed of a combination of the radiation conductor 82 and the upper ground conductor 83 short-circuited by the side ground conductor 84, thereby making it possible to further reduce the resonant frequency fr and the size of the overall antenna.

(5) Fifth Embodiment

Since a fifth embodiment has the same circuit configuration as the first embodiment except for a circuit associated with a single-side short-circuited MS antenna 90, later described, which is employed instead of the single-side short-circuited MS antenna 80 of the portable radio apparatus 20 (FIG. 4), description will be made herein only on the structure of the single-side short-circuited MS antenna 90.

Figure 11A:
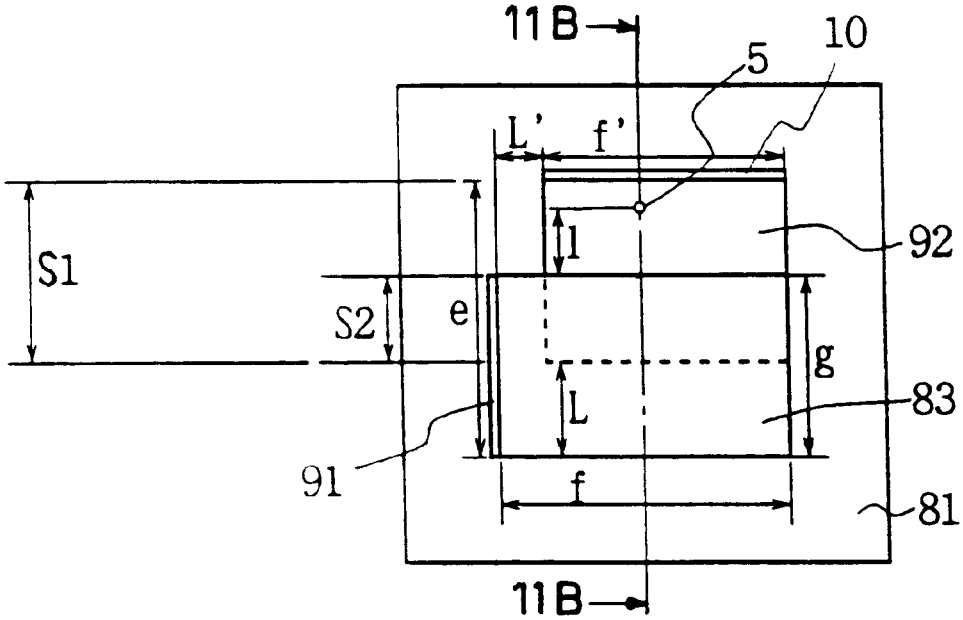
FIGS. 11A and 11B are a top plan view and a cross-sectional view illustrating the structure of a single-side short-circuited MS antenna according to a fifth embodiment of the present invention.
Figure 11B:
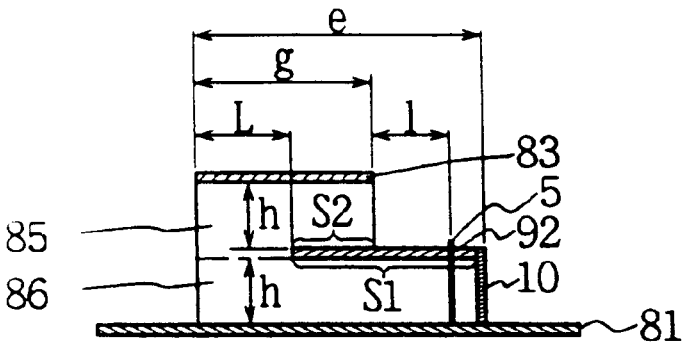

In FIGS. 11A and 11B, where parts corresponding to those in FIGS. 10A and 10B are designated with the same reference numerals, the single-side short-circuited MS antenna 90 comprises a side ground conductor 91 disposed on a side of an upper ground conductor 83 orthogonal to an open end side, on which a short-circuit conductor 10 is not disposed, so as to short-circuit the upper ground conductor 83 and a ground conductor 81, instead of the side ground conductor 84 of the single-side short-circuited MS antenna 80 in the fourth embodiment. In addition, a radiation conductor 92 has a width f' and is spaced apart from a side ground conductor 91 by a distance L' to avoid short-circuiting.

Again, in the single-side short-circuited MS antenna 90, the upper ground conductor 83 and the ground conductor 81 are short-circuited by the side ground conductor 91 in a manner similar to the single-side short-circuited MS antenna 80, so that a first antenna can be formed of a combination of the radiation conductor 92 and the ground conductor 81 short-circuited by the short-circuit conductor 10, and a second antenna can be formed of a combination of the radiation conductor 92 and the upper ground conductor 83 short-circuited by the side ground conductor 91.

In the foregoing structure, the single-side short-circuited MS antenna 90 is such that a first area S1 on one side of the radiation conductor 92 acting as the first antenna and a second area S2 on the other side of the radiation conductor 92 acting as the second antenna are added to increase the area of the radiation conductor 92 acting as the overall antenna, so that the capacitance of the antenna can be increased as a whole. Consequently, the single-side short-circuited MS antenna 90 can reduce the resonant frequency fr without causing increased dimensions (length e×width f), as compared with those of the conventional single-side short-circuited MS antenna 6.

Thus, the single-side short-circuited MS antenna 90 can further reduce the overall size thereof by an amount corresponding to a reduction in the resonant frequency fr, when operated at the same frequency as the conventional single-side short-circuited MS antenna 6, thereby making it possible to reduce the area of the antenna equipped in the portable radio apparatus 20 and hence the entire size of the portable radio apparatus 20.

In addition, since the single-side short-circuited MS antenna 90 employs an upper dielectric layer 85 and a lower dielectric layer 86 formed of air layers, the single-side short-circuited MS antenna 90 can be reduced in weight as compared with the conventional single-side short-circuited MS antenna 6 which employs the dielectric substrate 9.

According to the foregoing structure, the single-side short-circuited MS antenna 90 in the fifth embodiment employs the double-layer structure which includes the first antenna formed of a combination of the radiation conductor 92 and the ground conductor 81 short-circuited by the short-circuit conductor 10, and the second antenna formed of a combination of the radiation conductor 92 and the upper ground conductor 83 short-circuited by the side ground conductor 91, thereby making it possible to further reduce the resonant frequency fr and the size of the overall antenna.

(6) Sixth Embodiment

Since a sixth embodiment has the same circuit configuration as the first embodiment except for a circuit associated with a single-side short-circuited MS antenna 100, later described, which is employed instead of the single-side short-circuited MS antenna 80 of the portable radio apparatus 20 (FIG. 4), description will be made herein only on the structure of the single-side short-circuited MS antenna 100.

Figure 12A:
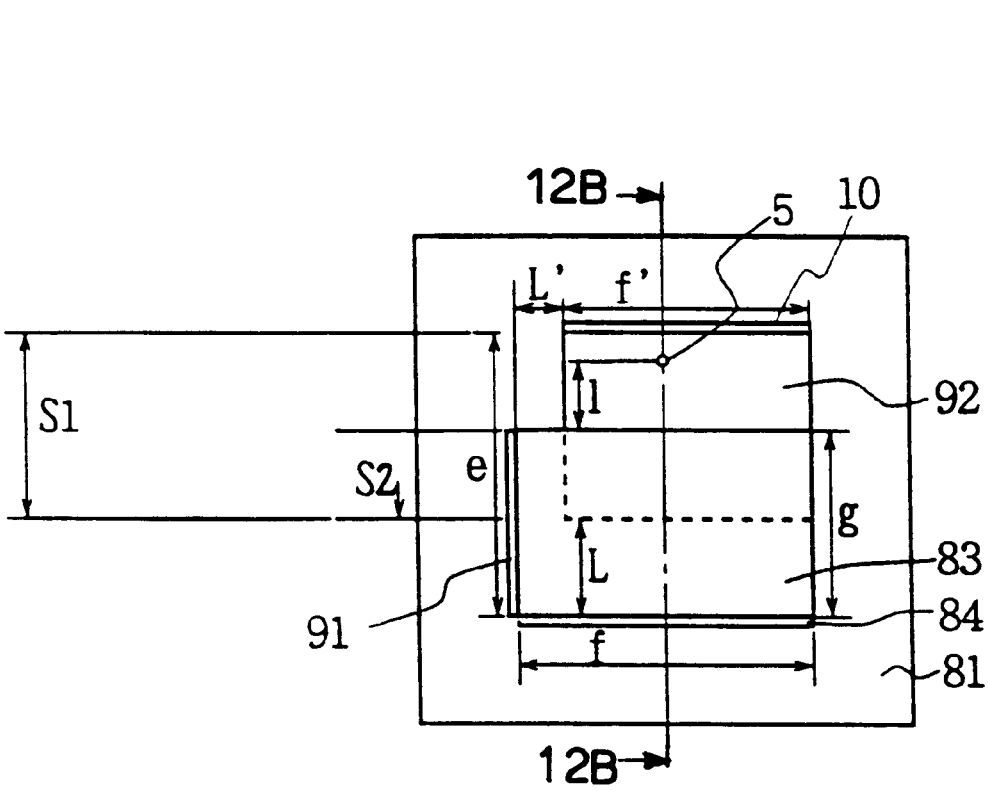
FIGS. 12A and 12B are a top plan view and a cross-sectional view illustrating the structure of a single-side short-circuited MS antenna according to a sixth embodiment of the present invention.
Figure 12B:
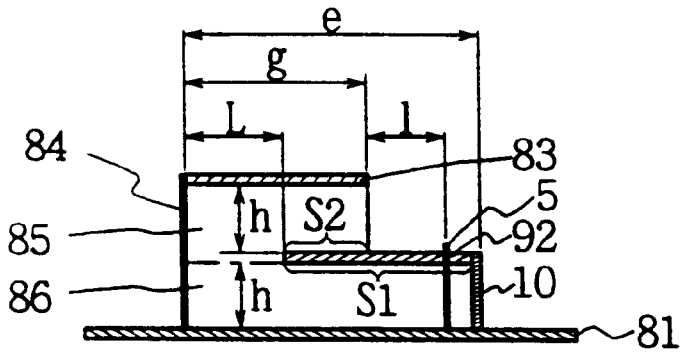

In FIGS. 12A and 12B, where parts corresponding to those in FIGS. 11A and 11B are designated the same reference numerals, the single-side short-circuited MS antenna 100 comprises both the side ground conductor 84 of the single-side short-circuited MS antenna 80 in the fourth embodiment, and the side ground conductor 91 of the single-side short-circuited MS antenna 90 in the fifth embodiment.

Again, in the single-side short-circuited MS antenna 100, an upper ground conductor 83 and a ground conductor 81 are short-circuited by the side ground conductors 84, 91 in a manner similar to the single-side short-circuited MS antennas 80, 90, so that a first antenna can be formed of a combination of a radiation conductor 92 and the ground conductor 81 short-circuited by a short-circuit conductor 10, and a second antenna can be formed of a combination of the radiation conductor 92 and the upper ground conductor 83 short-circuited by the side ground conductors 84, 91.

In the foregoing structure, the single-side short-circuited MS antenna 100 is such that a first area S1 on one side of the radiation conductor 92 acting as the first antenna and a second area S2 on the other side of the radiation conductor 92 acting as the second antenna are added to increase the area of the radiation conductor 92 acting as the overall antenna, so that the capacitance of the antenna can be increased as a whole. Consequently, the single-side short-circuited MS antenna 100 can reduce the resonant frequency fr without causing increased dimensions (length e×width f), as compared with those of the conventional single-side short-circuited MS antenna 6.

Thus, the single-side short-circuited MS antenna 100 can further reduce the overall size thereof by an amount corresponding to a reduction in the resonant frequency fr, when operated at the same frequency as the conventional single-side short-circuited MS antenna 6, thereby making it possible to reduce the area of the antenna equipped in the portable radio apparatus 20 and hence the entire size of the portable radio apparatus 20.

In addition, since the single-side short-circuited MS antenna 100 employs an upper dielectric layer 85 and a lower dielectric layer 86 formed of air layers, the single-side short-circuited MS antenna 100 can be reduced in weight as compared with the conventional single-side short-circuited MS antenna 6 which employs the dielectric substrate 9.

According to the foregoing structure, the single-side short-circuited MS antenna 100 in the sixth embodiment employs the double-layer structure which includes the first antenna formed of a combination of the radiation conductor 92 and the ground conductor 81 short-circuited by the short-circuit conductor 10, and the second antenna formed of a combination of the radiation conductor 92 and the upper ground conductor 83 short-circuited by the side ground conductors 84, 91, thereby making it possible to further reduce the resonant frequency fr and the size of the overall antenna.

(7) Other Embodiments

Figure 13A:
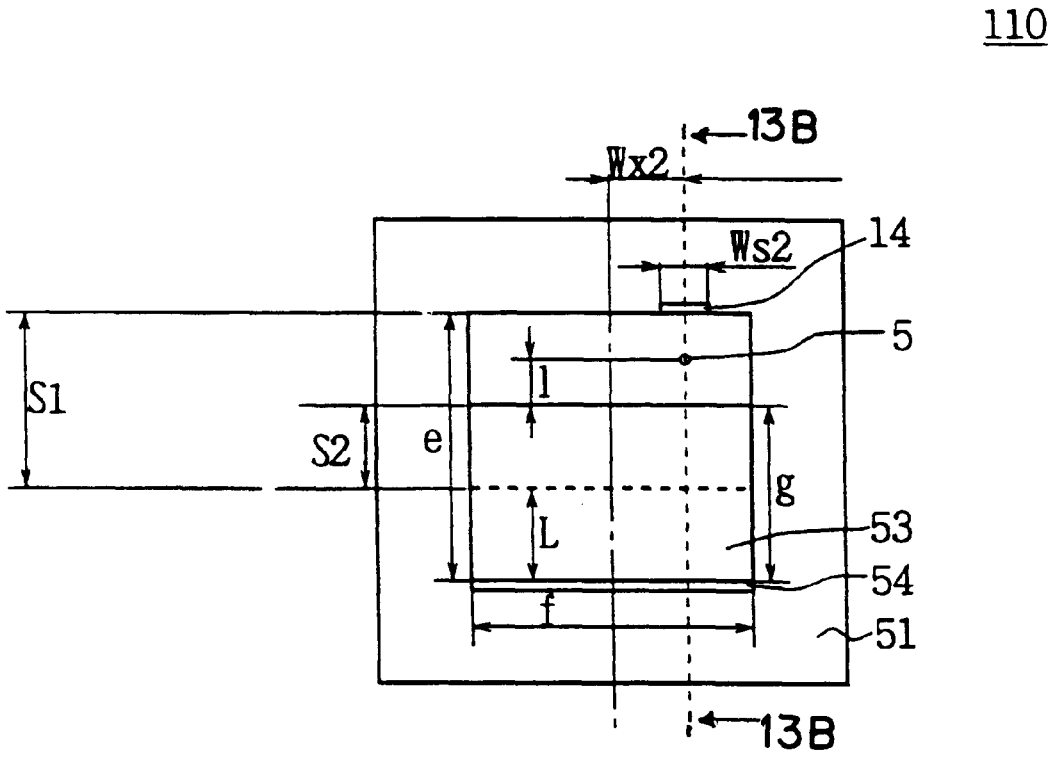
FIGS. 13A and 13B are a top plan view and a cross-sectional view illustrating the structure of a laminar inverted-F antenna according to another embodiment of the present invention.
Figure 13B:
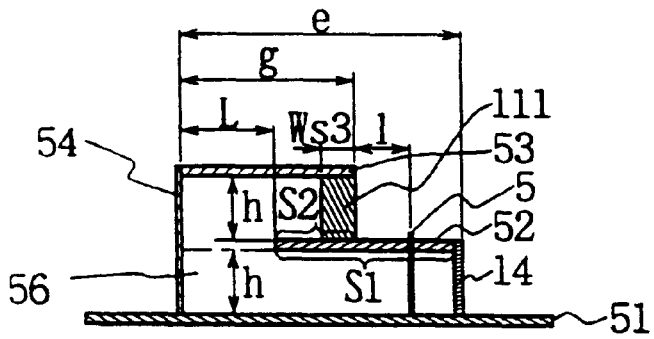

While the foregoing first to third embodiments have been described for the laminar inverted-F antennas 27, 60, 70 which have the upper dielectric layers 55 formed of air layers, the present invention is not limited to such particular dielectric layers as disclosed. Alternatively, as a laminar inverted-F antenna 110 illustrated in FIGS. 13A and 13B, a dielectric substrate 111 having a predetermined width Ws3 and a height h and made, for example, of glass fiber can be used instead of the upper dielectric layer 55. In this case, a variety of other materials can also be used for the dielectric substrate 111 other than glass fiber. In addition, the resonant frequency can be manipulated by adjusting the predetermined width Ws3 of the dielectric substrate 111.

Figure 14A:
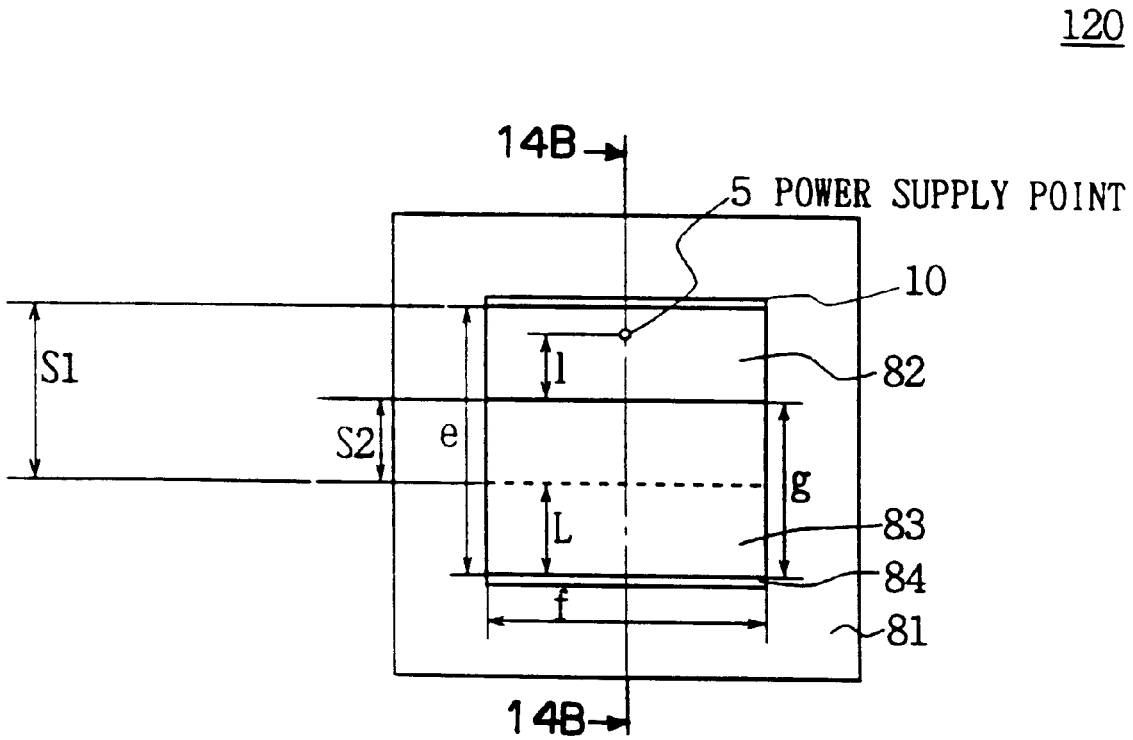
FIGS. 14A and 14B are a top plan view and a cross-sectional view illustrating the structure of a single-side short-circuited MS antenna according to another embodiment of the present invention.
Figure 14B:
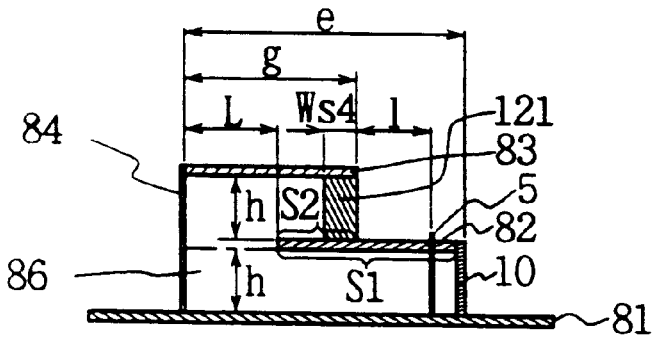

Also, while the foregoing fourth to sixth embodiments have been described for the single-side short-circuited MS antennas 80, 90, 100 which have the upper dielectric layers 85 formed of air layers, the present invention is not limited to such particular dielectric layers as disclosed. Alternatively, as a single-side short-circuited MS antenna 120 illustrated in FIGS. 14A and 14B, a dielectric substrate 121 having a predetermined width Ws4 and a height h and made, for example, of glass fiber can be used instead of the upper dielectric layer 85. In this case, a variety of other materials can also be used for the dielectric substrate 121 other than glass fiber. In addition, the resonant frequency can be manipulated by adjusting the predetermined width Ws4 of the dielectric substrate 121.

Further, while the foregoing first to sixth embodiments have been described in connection with the structures in which the upper dielectric layer 55 and the lower dielectric layer 56 or the upper dielectric layer 85 and the lower dielectric layer 86 are formed as separated, the present invention is not limited to such a structure. Alternatively, the upper dielectric layer and the lower dielectric layer can be integrally formed.

Further, in the foregoing first to sixth embodiments, the upper ground conductor 53 or 83 and the ground conductor 51 or 81 are short-circuited by the side ground conductor 54, 61, 84 or 91. The present invention, however, is not limited to such a structure, and in the alternative, the upper ground conductor and the ground conductor can be formed by bending an integrated conductor.

Further, in the foregoing first to sixth embodiments, the antenna device according to the present invention is applied to laminar inverted-F antennas and single-side short-circuited MS antennas. The present invention, however, is not limited to these particular types of antennas, but can be applied to a variety of other planar antennas which exhibit a varying resonant frequency depending on the area of a radiation conductor.

While there has been described in connection with the preferred embodiments of the invention, it will be obvious to those skilled in the art that various changes and modifications may be aimed, therefore, to cover in the appended claims all such changes and modifications as fall within the true spirit and scope of the invention.

What is claimed is:

1. An antenna device comprising:

a first flat ground conductor;

a flat radiation conductor having a side thereof disposed facing said first flat ground conductor interposing a first dielectric layer;

a first short-circuit conductor connecting a first edge of said flat radiation conductor and said first flat ground conductor;

a second flat ground conductor disposed facing and spaced apart from and partially overlapping another side of said flat radiation conductor opposite said side facing said first flat ground conductor and interposing a second dielectric layer between said flat radiation conductor and said second flat ground conductor;

a second short-circuit conductor connecting said second flat ground conductor and said first flat ground conductor, wherein said second short-circuit conductor is disposed spaced apart a predetermined distance from a second edge opposite said first edge of said flat radiation conductor; and a power supply point disposed at a predetermined position on said flat radiation conductor.

2. The antenna device according to claim 1, wherein said power supply point and said first short-circuit conductor are formed so that said antenna device functions as a laminar inverted-F antenna.

3. The antenna device according to claim 1, wherein said power supply point and said first short-circuit conductor are formed so that said antenna device functions as a single side short-circuited micro-strip antenna.

4. The antenna device according to claim 1, wherein said first and second dielectric layers are respective air layers.

* * * * *